US006772573B2

(12) United States Patent
Federeszyn

(10) Patent No.: US 6,772,573 B2
(45) Date of Patent: Aug. 10, 2004

(54) AUTOMATIC STRETCH FILM ROLL CHANGER

(75) Inventor: Roger Federeszyn, Pierrefonds (CA)

(73) Assignee: Orion Packaging Inc., Lavel Quebec (CA)

( * ) Notice: Subject to any disclaimer, the term of this patent is extended or adjusted under 35 U.S.C. 154(b) by 0 days.

(21) Appl. No.: 10/233,280

(22) Filed: Aug. 28, 2002

(65) Prior Publication Data

US 2003/0066269 A1 Apr. 10, 2003

Related U.S. Application Data

(60) Provisional application No. 60/315,421, filed on Aug. 28, 2001.

(51) Int. Cl.[7] ..... B65B 41/00; B65H 67/06

(52) U.S. Cl. ..... 53/389.2; 53/556; 242/559.2; 242/559.3; 242/559.4

(58) Field of Search ..... 53/389.2, 389.3, 53/556, 557, 558, 168; 242/559.3, 559.2, 559.4

(56) References Cited

U.S. PATENT DOCUMENTS

| | | | | | |
|---|---|---|---|---|---|
| 3,334,833 | A | * | 8/1967 | Embury | 242/559.2 |
| 3,546,850 | A | * | 12/1970 | Hatanaka | 53/389.2 |
| 4,185,442 | A | * | 1/1980 | Johnson et al. | 242/559.2 |
| 4,690,346 | A | * | 9/1987 | Takeda et al. | 242/532.3 |
| 4,914,891 | A | * | 4/1990 | Suolahti | 53/556 |
| 5,203,139 | A | * | 4/1993 | Salsburg et al. | 53/587 |
| 5,655,356 | A | * | 8/1997 | Ginestra et al. | 53/389.3 |
| 6,082,081 | A | * | 7/2000 | Mucha | 53/556 |
| 6,616,087 | B1 | * | 9/2003 | Chern | 242/559.2 |

* cited by examiner

*Primary Examiner*—John Sipos
(74) *Attorney, Agent, or Firm*—J. Herbert O'Toole; Nexsen Pruet, LLC

(57) ABSTRACT

A film roll changer for a stretch film wrapping device provides rolls of film on a turntable. The changer moves into position beneath a roller carriage assembly, lifts a carrier plate to remove a spent roll, rotates a new roll into place, inserts the film into the roller carriage, pulls out an end of the film. The changer then closes the carriage assembly and transfers the film end to the wrapping device.

3 Claims, 7 Drawing Sheets

AUTOMATIC STRETCH FILM ROLL CHANGER

This application claims the benefit of U.S. Provisional Patent Application 60/315,421 filed Aug. 28, 2001.

TECHNICAL FIELD

This invention relates generally to stretch wrapping apparatus and, more particularly, to a method for automatically changing the rolls of stretchable film during continuous operation.

BACKGROUND OF THE INVENTION

Since its development in the 1970's stretched plastic film has been used to secure cartons and bags on pallets for shipment. Films are stretched in a carriage and wrapped around the stacked product on a pallet. Two basic designs of wrapping apparatus are in use. The pallet may be placed on a turntable and the stretchable film dispensed from a stationary roll dispenser (rotary arm wrapper). In the alternative, the load may be stationary and the film wrapped using a rotating film dispenser (rotary arm wrapper). Turntable stretch wrapping apparatus is suitable for small volume production whereas the rotary arm wrapper may be integrated into a conveyor system and is more suitable for high volume production.

Regardless of the design of a stretch wrap packaging machine it has heretofore been necessary to manually reload the film roll when the roll has been consumed or, in the off chance the film breaks during wrapping. In most applications a roll of film is consumed at intervals of two to three hours and someone must be designated to monitor the wrapping machine while being committed to other tasks. In an automated environment, the production line would become stopped until someone manually reloaded the film.

U.S. Pat. No. 6,082,081 to Mucha discloses a pre-stretched roller assembly of a clam shell-type design which opens about a hinge and facilitates the loading of a stretch film. This film stretching apparatus is the preferred carriage assembly for use in an automated system for loading replacement film rolls.

BRIEF SUMMARY OF THE INVENTION

It is the first objective of this invention to provide a completely automated system for replacing rolls of stretch film used in a carriage assembly for stretch wrapping of product on pallet and other shipping forms.

It is a second objective of this invention to provide a means for automatically responding to broken or torn film during wrapping with minimal stoppage of production lines.

It is yet another objective of this invention to facilitate unmanned operation of a packaging line with minimal attention requirements from production workers.

These and other objectives of the invention are obtained by providing an automatic changer for a stretch film having a turntable, a plurality of film mandrels removably attached to the turntable, an elevator, a means for opening a film delivery system prestretch roller assembly, a means for engaging the film mandrels into the roller assembly, a means for anchoring the end of the film separate from the roller assembly, a means for anchoring one end of the film away from the mandrel to provide a stationary source and a means for moving the turntable toward and away from the pre-stretched roller assembly.

DETAILED DESCRIPTION

This invention provides a method for automating the loading of stretch wrap film into a commercially available prestretch roller assembly such as that disclosed in U.S. Pat. No. 6,082,081. Numerous stretchable films are commercially available and the specific chemical composition and source of the film are not critical to this invention.

Figure 1:
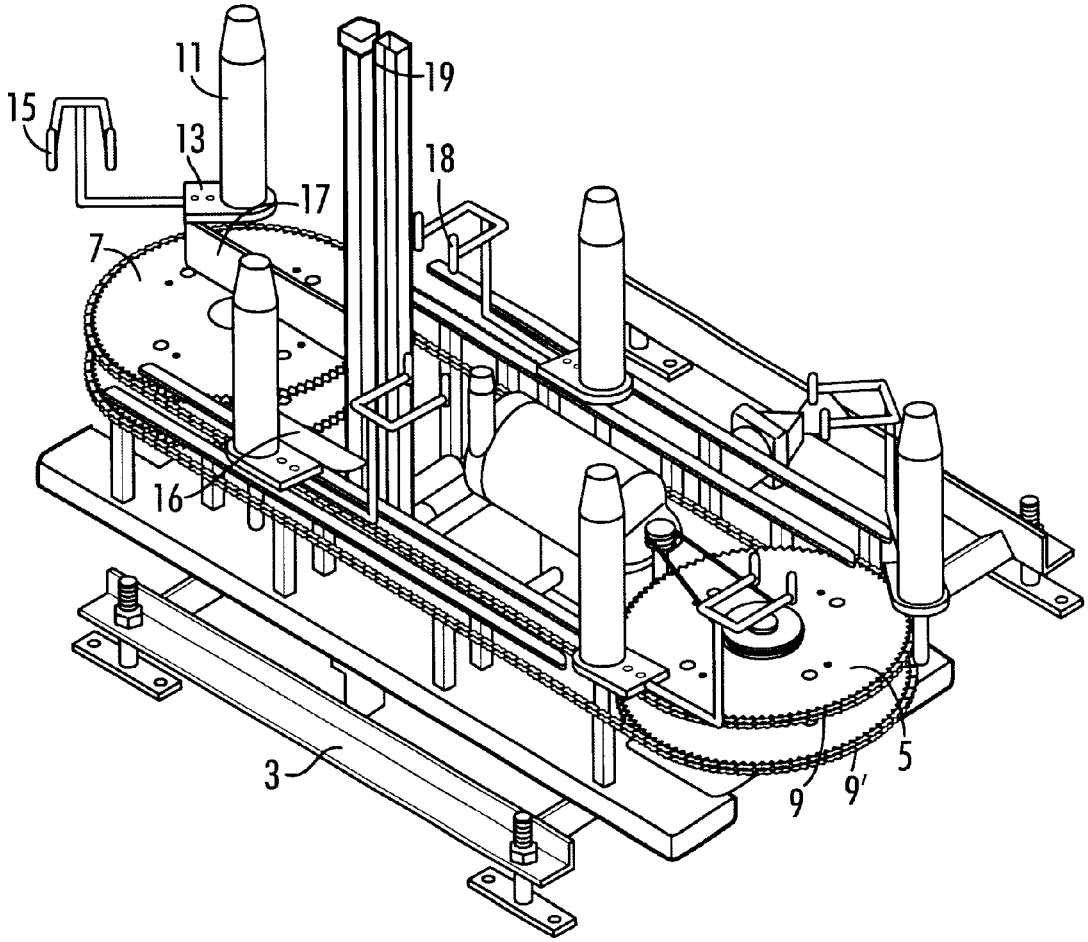
FIG. 1 is a perspective view of the base of an automatic changer and associated to the components.

FIG. 1 is a perspective view of the base and associated components of the film changer of this invention. A base 1 supports the operative components and is anchored to a floor using conventional angle iron brackets shown as element 3. A turntable in the form of an oval raceway has a first sprocket 5 and a second sprocket 7 around which are wound an upper endless chain 9 and a lower endless chain 9'. The oval shape of the raceway is not critical and a circular, rectangular or other pathway may be used dependant on space limitations and needed capacity. Traveling on the chains are film mandrels 11 supported upon a carrier 13 which are, in turn, supported on the endless chains. Film mandrels, to be discussed infra, carry rolls of film typically wrapped around a core which may be cardboard or plastic. A holder 15 extended from carrier 13 holds the extended end of the stretch film. The film is extended so that a film drawing assembly 17 having clamp 18 may be used to pull a length of film from the roll prior to wrapping of the film around a stacked pallet. Element 19 is a film lift elevator guide which is employed to guide lift 16, raise the film into a film delivery carriage for wrapping and to remove empty rolls or torn rolls of film.

Figure 2:
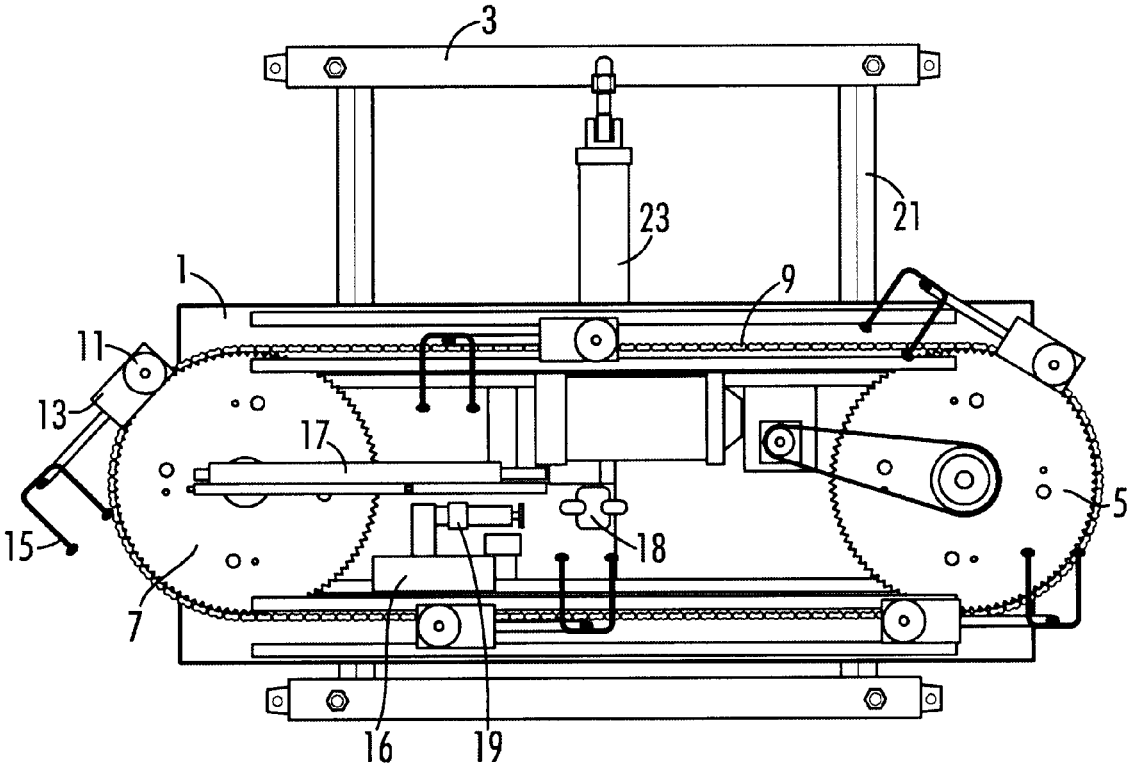
FIG. 2 is a plan view of the base shown in FIG. 1.

FIG. 2 is a plan view of the base shown in FIG. 1. In plan view, it may be seen that the base 1 travels on rails 21 under the control of the cylinder 23 mounted upon the base 1 and the floor mounting assembly 3. The movement facilitates approach and withdraw from a film delivery system.

Figure 3:
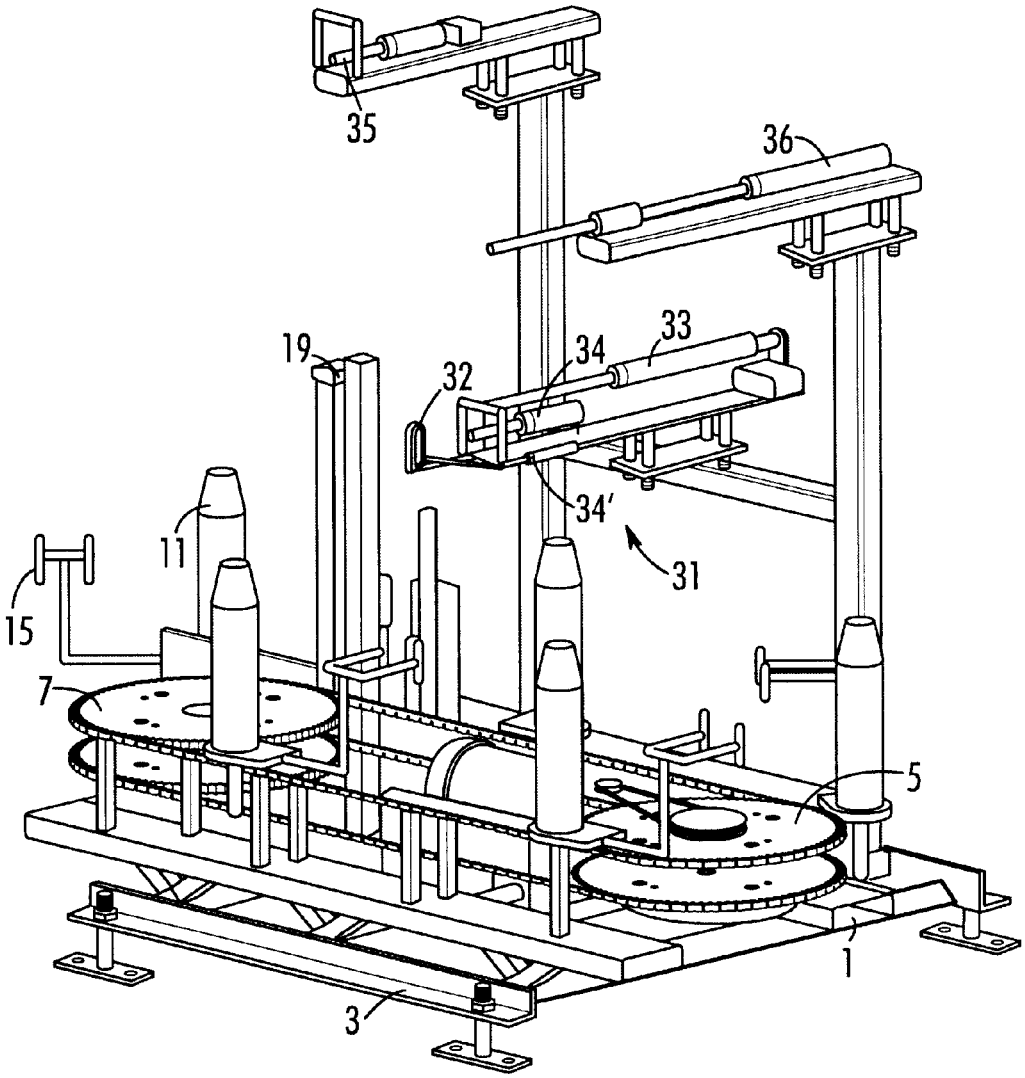
FIG. 3 is a perspective view of the automatic changer of FIG. 1 showing elevated ancillary components.

FIG. 3 is a perspective view of the base showing also superstructural components necessary to insert the film into a film delivery system. Element 31 is a means for opening a film delivery system including a pre-stretched roller assembly. As illustrated, cradle opening hook 32 under the control of a pneumatic cylinder 33, 34' extends and retracts the device. As shown, the hook is also under control of a second cylinder 34 so that it may be raised and lowered. Alternatively, a magnetic or suction device may be used in lieu of a hook and the worm gear and stepper motor may be substituted for pneumatic cylinders.

Element 35 is an extensible device (robotic arm) employed to lock and unlock a mandrel into a stretch wrap film holder on a film delivery system. The device is extensible in the same manner as is the arm 31 and the end is adapted to a specific mandrel mounting configuration as will be discussed infra.

Element 36 is an extensible arm which is used to fix or hold a film delivery system carriage assembly while the mandrel and stretchable film are being loaded into place (or unloaded). Pneumatic, hydraulic or electric controls are suitable means for extending all of these devices although pneumatic is preferred.

Figure 4:
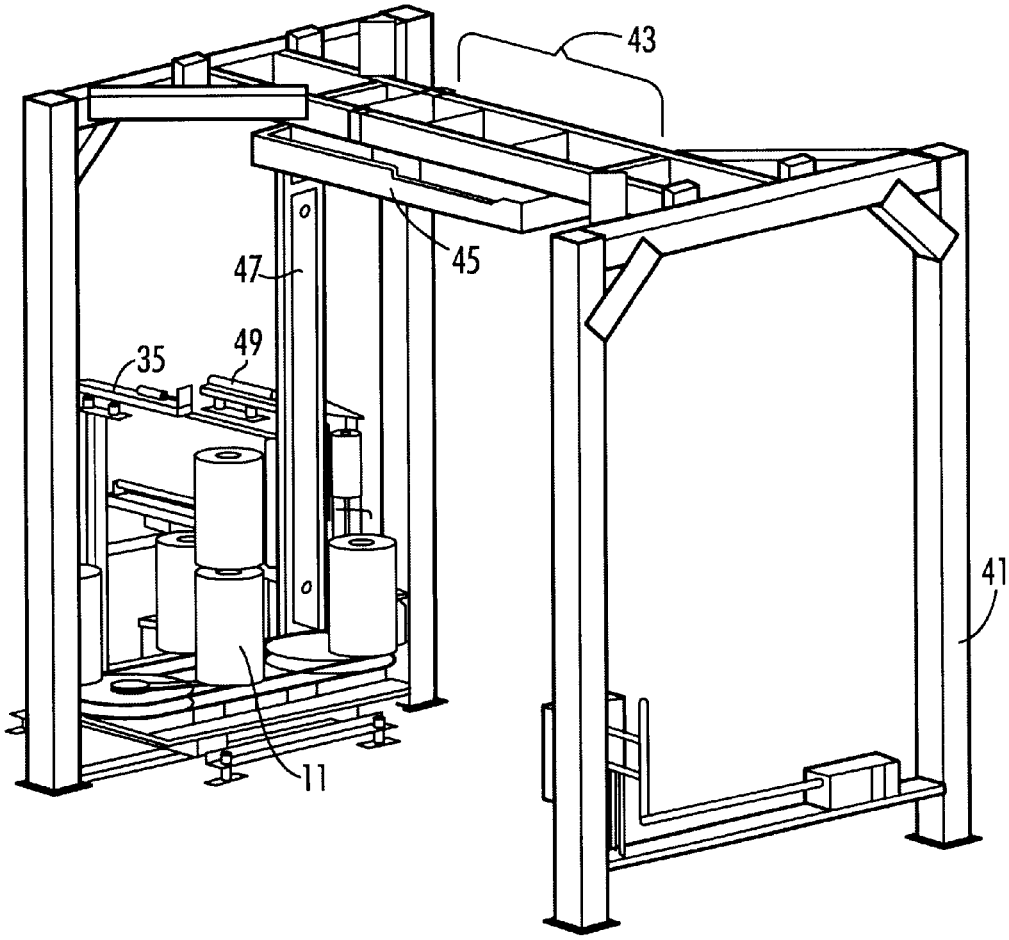
FIG. 4 illustrates the relationship of the automatic changer to the stretch film wrapping apparatus.

FIG. 4 illustrates the relationship of the automatic changer of this invention to a stretch film delivery system. The stretch film delivery system as illustrated is that which is available from Orion Packaging, TM Montreal Canada and is exemplary of stretch wrap systems which are compatible with conveyor systems. A framework 41 which has a substantially rectangular plan view supports a rotary frame assembly 43 having a swing arm 45 and a suspended ladder bar 47 carrying the film carriage 49.

Figure 5:
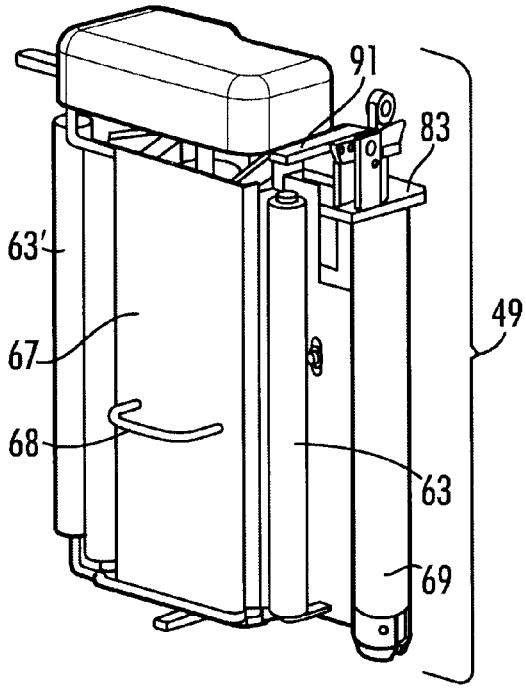
FIG. 5 shows the film wrapping carriage in perspective view.

FIG. 5 shows a perspective view of a stretch film carriage such as that disclosed in U.S. Pat. No. 6,082,081. The assembly 49 has a brace of idle rollers 63 and 63' and pre-stretch roller cover 67. As illustrated, cover 67 has a handle 68 engageable with hook 32. Alternative embodiments may provide different methods for engagement of the opening apparatus with the roller cover may include, inter alia, a magnetic disc such as might be used with an alumentium or plastic cover. Various forms of lock and key arrangements are a matter of design choice. Mandrel 69 which carries the stretch film is suspended from the cradle assembly.

Figure 6:
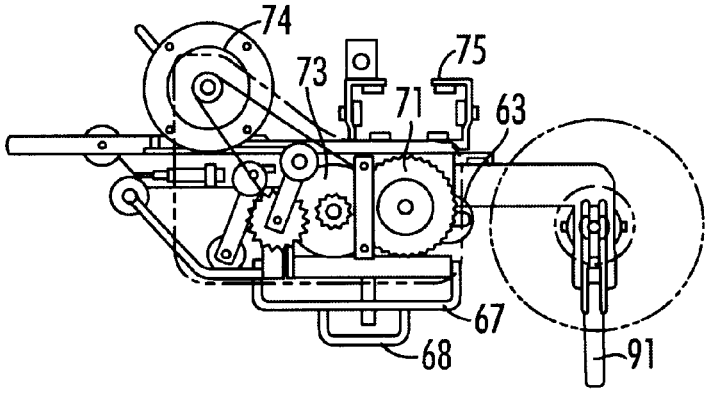
FIG. 6 shows the film wrapping carriage in plan view.

FIG. 6 is a plan view of the film carriage and illustrates the location of the first stretch roller 71 and the second stretch roller 73, the edge attachment assembly 75 and a drive motor 74.

Figure 7A:
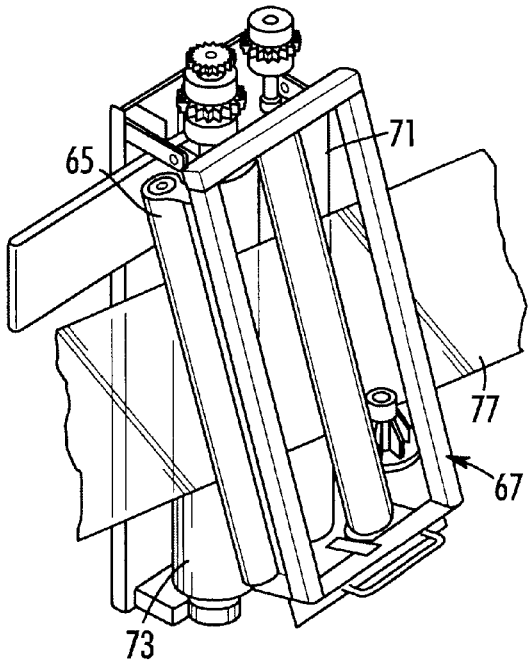
FIG. 7A shows the film wrapping carriage in the open position.
Figure 7B:
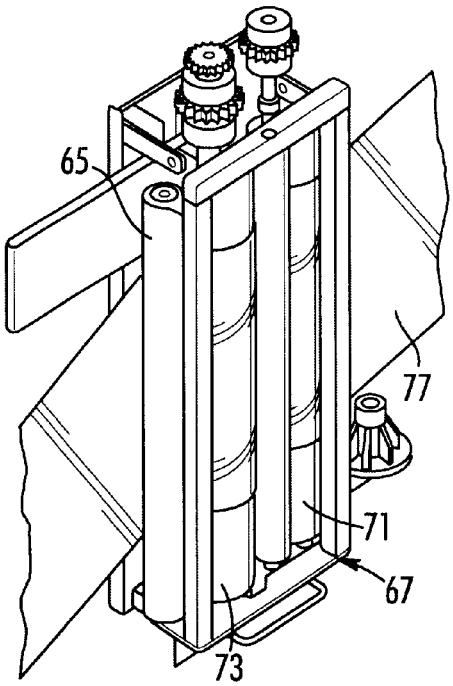
FIG. 7B shows the film wrapping carriage in the closed position.

FIG. 7 shows the film carriage assembly from U.S. Pat. No. 6,082,081 in the opened position with film 77 positioned between stretch and idle rollers. When roller cover 67 is closed the film is in frictional engagement between the stretch rollers and may be stretched at any predetermined ratio up to and including 300%. While the early frame assembly 43 is being spun around a stacked pallet on a conveyor line within the frame assembly 41.

Figure 8A:
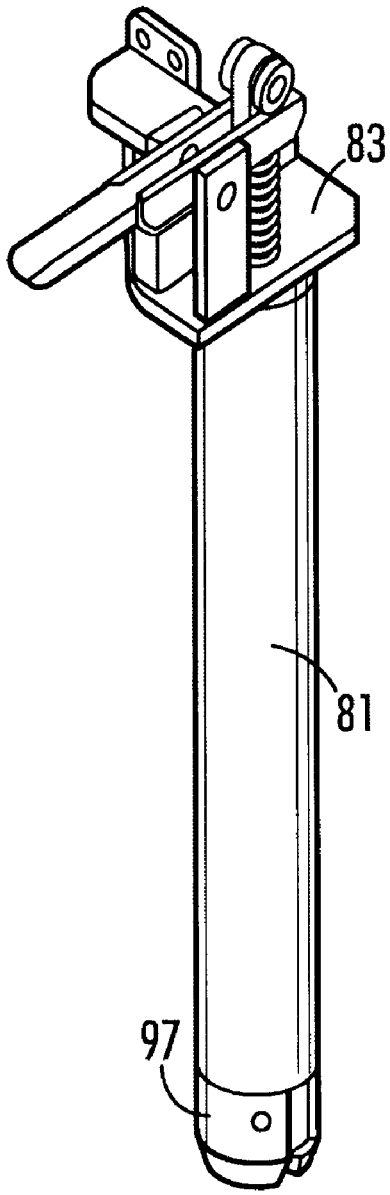
FIGS. 8A and 8B show a mechanism for attaching a film mandrel to a carriage.
Figure 8B:
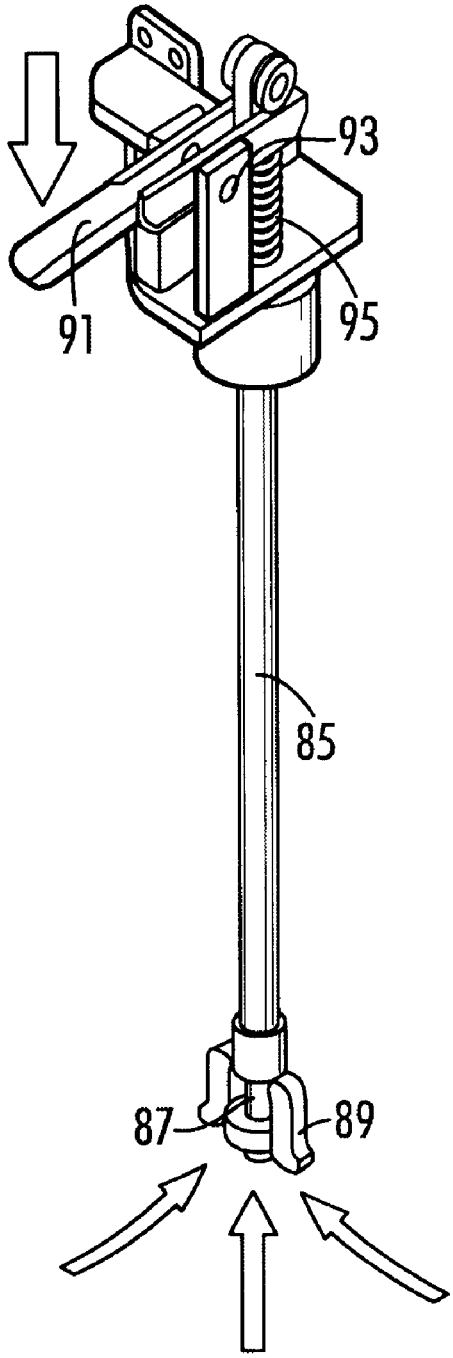

FIG. 8A shows a mandrel 81 in place on mounting bracket 83 attached to the carriage. FIG. 8B shows the actuation method whereby the mandrel is attached. Shaft 85 extends downwardly from the bracket and serves as an axle. Push rod 87 actuates latch 89 under the control of lever 91 articulated on hinge pin 93 to open and close latches 89. Spring 95 returns to lever 91 and latch 89 to the locked position and hold the mandrel 81 in place when latch 89 engages receiver 97 of the mandrel. The lever is urged into the open position by actuation of locked controller 32.

OPERATION

The automatic film roll changer is controlled by a CPU, preferably by the same CPU which controls the wrapping carriage. The sequence starts with the loading of the carriage. The carriage 49 parks in front of elevator 16. Frame 1 moves across rails 21 at the urging of pneumatic or hydraulic cylinder 23 or an equivalent device such as a worm gear and gimbal nut. When in position, hook 32 or equivalent means retracts cover 67 by pulling back on handle 68 to separate rollers. 63, 65, 71 and 73 while brace 36, in the extended position, stabilizes the carriage. Mandrel lock controller 35 actuates lever 91.

Travel clamp 18 grasps film from film end holder 15 and extends the film away from the carriage.

Film draw assembly 17 clamps and extends an end of the film held by film end holder 15. Elevator lift 16 engages mandrel carrier 13 to raise the film mandrel 11 until it engages shaft 85 and is locked in place by mandrel lock controller 35. Roller cradle assembly 61 is closed by opener 31. The extended film end is clasped by film tail treatment device 51 and released by the draw assembly 18. The elevator returns to its lowered position and the base 1 is retracted by cylinder 23.

The carriage is now loaded and may be used to wrap the next load on a pallet.

When the film breaks during wrapping or when the roll of film has been exhausted, the film carriage returns to the film loading position.

The film roll changer base is moved toward the carriage, the elevator lifts an empty carrier 13 under the empty mandrel which is released by controller 35 and lowered back to the turntable. The base 1 is withdrawn and the turntable rotated to the next full roll and loading sequence begins again. The turntable steps around one position and the aforementioned loading sequence is commenced.

The sequence of events may be controlled by a CPU either on the unit or remotely. Commercially available "personal computers" are sufficient although a dedicated programmable controller is preferred.

The invention has been illustrated and described in a preferred embodiment but any modification substitution or additions may be made as apparent to any person skilled in the art without departing from the scope of the invention and the appended claims.

I claim:

1. An automatic changer for a stretch film wrapping device having a film delivery system prestretch carriage assembly with an openable cover comprising:

1) a turntable mounted on a frame;
2) a plurality of film mandrels removably attached to said turntable;
3) an elevator means; for lifting one of said mandrels
4) means for opening the cover of said a film delivery system prestretch roller carriage assembly;
5) means for engaging said film mandrels into said roller carriage assembly;
6) means for anchoring an end of a film attached to a mandrel and;
7) means for moving said turntable and frame horizontally toward and away from said roller assembly.

2. An automatic changer according to claim 1 further comprising means for stabilizing said roller carriage assembly.

3. An automatic changer according to claim 1 wherein said elevator means, said means for opening a film delivery system prestretch roller carriage assembly, means for engaging said film mandrels and means for moving are pneumatically operated.

* * * * *